US006242403B1

(12) United States Patent
Lammers et al.

(10) Patent No.: US 6,242,403 B1
(45) Date of Patent: Jun. 5, 2001

(54) DETERGENT COMPOSITIONS

(75) Inventors: Rene Lammers, Bangkok (TH); Seeng Djiang Liem, Vlaardingen (NL); Alastair Richard Sanderson, Bebington (GB); Bart Slenderbroek, Vlaardingen (NL); Harmannus Tammes, Vlaardingen (NL); Arie Vermaas, Vlaardingen (NL); Gilbert Martin Verschelling, Bebington (GB); Ronaldus Wilhelmus Johannes Westerhout, Vlaardingen (NL)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/447,643

(22) Filed: Nov. 23, 1999

(30) Foreign Application Priority Data

Nov. 27, 1998 (GB) ..... 9826097

(51) Int. Cl.[7] ..... C11D 17/00; C11D 11/00; C11D 3/06

(52) U.S. Cl. ..... 510/294; 510/298; 510/361; 510/446; 510/510; 510/512

(58) Field of Search ..... 510/294, 298, 510/361, 446, 510, 512

(56) References Cited

U.S. PATENT DOCUMENTS

| | | | | |
|---|---|---|---|---|
| 3,324,038 | * | 6/1967 | Chaffee et al. | 510/439 |
| 3,367,880 | * | 2/1968 | Keast et al. | 510/298 |
| 3,557,003 | * | 1/1971 | Morris et al. | 510/298 |
| 4,219,435 | * | 8/1980 | Biard et al. | 510/439 |
| 4,451,386 | | 5/1984 | Joshi | 252/135 |
| 5,225,100 | * | 7/1993 | Fry et al. | 510/298 |
| 6,051,545 | * | 4/2000 | Boskamp | 510/446 |

FOREIGN PATENT DOCUMENTS

| | | |
|---|---|---|
| 466 485 | 1/1992 | (EP) . |
| 482 627 | 4/1992 | (EP) . |
| 711 827 | 5/1996 | (EP) . |
| 838 519 | 4/1998 | (EP) . |
| 839 906 | 5/1998 | (EP) . |
| 98/54289 | 12/1989 | (WO) . |
| 96/06916 | 3/1996 | (WO) . |
| 96/06917 | 3/1996 | (WO) . |
| 97/32002 | 9/1997 | (WO) . |
| 98/24875 * | 6/1998 | (WO) . |
| 98/54278 | 12/1998 | (WO) . |
| 98/54281 | 12/1998 | (WO) . |
| 98/54287 | 12/1998 | (WO) . |

* cited by examiner

*Primary Examiner*—Lorna M. Douyon
(74) *Attorney, Agent, or Firm*—Rimma Mitelman

(57) ABSTRACT

A detergent tablet of compressed particulate composition, and a process of making such a tablet, wherein the tablet or a region thereof comprises organic detergent and detergency builder and the tablet or region thereof is compacted from a composition which contains:

(A) particles containing at least 60% by weight of non-soap anionic detergent (B) particles containing at least 80% of their own weight of one or more water-soluble materials selected from compounds with a water-solubility exceeding 50 grams per 100 grams water at 20° C.; and sodium tripolyphosphate containing at least 50% of its own weight of the phase I anhydrous form.

26 Claims, No Drawings

DETERGENT COMPOSITIONS

This invention relates to detergent compositions in the form of tablets for use in fabric washing. Such tablets have the advantage that they do not require the user to measure out a volume of powder or liquid. Instead one or several tablets provide an appropriate quantity of composition for washing a single load in a washing machine or possibly by hand. They are thus easier for the consumer to handle and dispense.

Detergent compositions in tablet form have been described in a number of documents and are sold commercially.

Such tablets are generally made by compressing or compacting a quantity of detergent composition in particulate form. It is desirable that tablets should have adequate mechanical strength when dry before use, yet disintegrate and disperse/dissolve quickly when added to wash water. There is difficulty in achieving both properties simultaneously. As more pressure is used when a tablet is compacted, so the tablet density and strength rise, but there is also a reduction in the speed of disintegration/dissolution when the tablet comes into contact with wash water at the time of use. Organic detergent serves as a binder, but a typical quantity of such detergent can also retard disintegration and dissolution of a tablet. Our EP-A-466485 explains that as a tablet is wetted, anionic detergent can form viscous phases which retard penetration of water into the tablet interior.

This EP-A-466485 describes detergent tablets in which anionic detergent is contained within a first particulate component of the composition. This first particulate component provides from 2 to 40% of the overall composition. In some of the examples the detergent is provided as noodles or flakes containing approximately 80 to 90% of anionic detergent in which case these noodles or flakes provide only a small percentage of the composition.

In most examples in this document the nonionic detergent was mixed with or carried in particles which provided a majority of the overall composition.

Subsequent development placed reliance on materials which were effective to promote disintegration, the organic detergent which acts as binder being present at moderate concentration in particles which provide a substantial proportion of the composition. This has led to products which are marketed commercially.

In some tablets which are currently marketed commercially, the anionic and nonionic detergent are incorporated into a spray-dried base powder which is mixed with other ingredients to form the composition stamped into tablets.

The spray-dried base powder constitutes about 40% of the composition. It contains anionic detergent as approximately 25% of the base powder and nonionic detergent as approximately 12% of the same spray-dried base powder. The other ingredients of the composition include sodium tripolyphosphate which is partially hydrated and which is rich in the Phase I form of anhydrous sodium tripolyphosphate, in accordance with the teaching of our EP-A-839906 which teaches the efficacy of this form of sodium tripolyphosphate as a way to achieve rapid disintegration. This sodium tripolyphosphate is present as just over 30% of the tablet.

In other tablets which are marketed commercially the anionic and nonionic detergent are incorporated into a granulated, non-phosphate base powder. This also constitutes slightly over 40% of the relevant composition. The balance of the composition contains a highly water soluble salt.

This is consistent with our EP-A-711827 and EP-A-838519 teach that the speed of disintegration of tablets with water-insoluble non-phosphorus builder can be accelerated by including a highly water soluble salt. Organic detergent was included as a granulated base powder. In EP-A-838519 one example of base powder contained 20% anionic detergent and 15% nonionic detergent.

We have now found good results with tablets having novel formulations which include particles which contain a relatively high concentration of organic detergent. These tablets may be either homogeneous or heterogeneous. In the present specification, the term "homogeneous" is used to mean a tablet produced by compaction of a single particulate composition, but does not imply that all the particles of that composition will necessarily be of identical composition. The term "heterogeneous" is used to mean a tablet consisting of a plurality of discrete regions, for example layers, inserts or coatings, each derived by compaction from a particulate composition. In a heterogenous tablet, each discrete region of the tablet will preferably constitute at least 10% of the overall weight of the tablet.

According to a first aspect of this invention there is provided a detergent tablet of compressed particulate composition, wherein the tablet or a region thereof comprises organic detergent and detergency builder, characterised in that the tablet or region thereof is compacted from a composition which contains:

(A) particles containing at least 60% by weight of non-soap anionic detergent (B) particles for enhancing tablet disintegration which contain one or more water-soluble materials selected from compounds with a water-solubility exceeding 50 grams per 100 grams water at 20° C.;

sodium tripolyphosphate containing at least 50% of its own weight of the phase I anhydrous form, and preferably partially hydrated so as to contain water of hydration in an amount which is at least 1% by weight of the sodium tripolyphosphate.

We have found that such tablets give a good combination of properties, notably strength prior to use, and rapid disintegration when placed in contact with water at the time of use.

The particles for enhancing disintegration preferably are substantially free of organic detergent, containing at most 5% of their own weight of organic detergent.

Preferably they contain at least 50%, better at least 80% of their own weight of the compound(s) with water-solubility exceeding 80 gms per 100 gm water and/or specified sodium tripolyphosphate. The balance, if any, of their content is preferably other water soluble material.

A tablet of this invention will generally contain, overall, at least 5%, better at least 8%, up to not over 40%, possibly not over 30%, by weight of non-soap organic detergent which is preferably a combination of anionic and nonionic detergents;

at least 15%, better at least 20 or 25%, up to 80%, possibly not over 70 or 60% by weight of one or more detergency builders which may be water-soluble, water-insoluble or a mixture of soluble and insoluble builders;

optionally other ingredients which may amount to at least 10% by weight of the tablet.

Constituent materials for detergent tablets will now be discussed in more detail, and various optional and preferred features will be mentioned.

Anionic Detergent Particles

The anionic detergent particles preferably comprise from 60 to 99% by weight, more preferably from 65 to 96% by weight, of anionic detergent which is one or more a non-soap organic compounds with detersive surfactant properties.

The anionic detergent may comprise, wholly or predominantly, linear alkyl benzene sulphonate of the formula

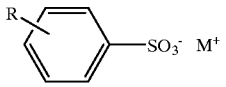

where R is linear alkyl of 8 to 15 carbon atoms and $M^+$ is a solubilising cation, especially sodium.

Primary alkyl sulphate having the formula $$ROSO_3^-M^+$$

in which R is an alkyl or alkenyl chain of 8 to 18 carbon atoms especially 10 to 14 carbon atoms and $M^+$ is a solubilising cation, is also commercially significant as an anionic detergent and may be used in this invention.

Frequently, such linear alkyl benzene sulphonate or primary alkyl sulphate of the formula above, or a mixture thereof will be the desired non-soap anionic detergent and may provide 75 to 100 wt % of the anionic non-soap detergent in the particles.

Examples of other non-soap anionic detergents which may be used include olefin sulphonates; alkane sulphonates; dialkyl sulphosuccinates; and fatty acid ester sulphonates. The anionic detergent particles may contain some nonionic detergent. The anionic detergent particles may also contain minor ingredients such as water, sodium carboxymethylcellulose, fluorescers, dyes, etc.

The anionic detergent particles may optionally contain from 0 to 40% by weight of detergency builder. The builder material may comprise soluble builder such as salts (preferably sodium salts) of tripolyphosphate, carbonate, silicate, sesquicarbonate, citrate or mixtures thereof, or burkeite (a double salt or sodium sulphate and sodium carbonate), nitrilotriacetate, polycarboxylic acid monomer, polycarboxylic acid polymer, polycarboxylic acid/maleic acid copolymer or mixtures thereof.

The builder may comprise insoluble builder such as aluminosilicate. The aluminosilicate may comprise zeolite, in particular zeolite MAP, zeolite 4A, amorphous aluminosilicate and mixtures thereof. It is particularly preferred, however, that the quantity of aluminosilicate builder is low. Preferably, aluminosilicate builder or other insoluble material provides less than 25% by weight of the anionic detergent particles, more preferably less than 15%.

The anionic detergent particles may be manufactured by mixing the components in a high speed mixer to agglomerate the components.

Processes for producing particles containing high quantities of anionic detergent are set out in WO 96/06916A and WO 96/06917A (Unilever). In these processes, an aqueous paste containing an anionic detergent, or alternatively an acid detergent precursor and also an alkaline neutralising agent are fed into a drying zone where the paste material is heated to reduce the water content thereof, the dried material being subsequently cooled in a cooling zone to form detergent particles.

Desirably the drying zone is under a slight vacuum to facilitate the removal of water and volatiles. The vacuum may be from 100 Torr up to atmospheric pressure as this provides significant process flexibility. However, a vacuum in excess of 500 Torr up to atmospheric has the advantage of reducing capital investment whilst providing vacuum operation.

The process may be carried out in any suitable apparatus, but it is preferred that a flash reactor is employed. Suitable flash reactors include e.g. the Flash Drier system available from VRV Spa Impianti Industriali. The drying zone may have a heat transfer area of at least 10 $m^2$ The cooling zone desirably has a heat transfer area of at least 5 $m^2$.

As described in our WO97/32003A, the material in the cooling zone may be treated with a stream of cooling gas. Alternatively, finely divided non-detergent solid material, such as zeolite or silica particles, may be introduced into this zone to adhere to the surface of the particles. Such material may provide from 3 to 25% of the weight of the particles.

The above process routes can provide flash-dried detergent particles comprising at least 60% by weight of the particle of an anionic detergent and not more than 5% by weight of the particle of water.

These anionic detergent particles may comprise anionic detergent in an amount of at least 66% by weight of the particles, even better at least 70% but possibly not over 96%. The particles may have a porosity of from 0 to 25% by volume of the particle and a particle size distribution such that at least 80% of the particles have a particle size of 180–1500 microns. As mentioned the anionic detergent may be formed in situ by neutralisation of a free acid. The neutralising agent may be sodium hydroxide solution or sodium carbonate. However, in situ neutralisation is unlikely to be appropriate when the anionic detergent is primary alkyl sulphonate (PAS) because its acid form is unstable.

All or at least a high proportion, at least 50 or 80% of the anionic detergent present in the tablet or region thereof may be provided by the anionic detergent particles defined above. Alternatively, the anionic detergent particles defined above may only provide between 10 and 50% of the total anionic detergent content of the tablet or region thereof and thus act as a supplement to another source of anionic detergent, such as a base powder.

Anionic detergent particles may provide from 3% to at least 30% of the weight of the tablet or region of a tablet. The amount of them may be at least 5%, 8% or 10%. Their amount may be not over 20% of the weight of the tablet or region, especially when the particles contain at least 70 or 75% of their own weight of non-soap anionic detergent. Their amount may be not over 10% of the weight of the tablet or region, especially if the anionic detergent particles are not the only source of anionic detergent in the tablet or region thereof.

Nonionic Detergent Particles

As mentioned above, tablets of this invention will preferably include a nonionic detergent. Although some nonionic detergent may be included with the anionic detergent in the particles discussed above, we prefer to incorporate nonionic detergent as separate particles. Such nonionic detergent particles preferably comprise at least 20% of their own weight of nonionic detergent.

Such nonionic detergent particles preferably contain less than 10% by weight of anionic detergent, and preferably substantially no anionic detergent.

Nonionic detergent compounds include in particular the products obtainable by reaction of alkylene oxides, especially ethylene oxide with compounds having a hydrophobic group and a reactive hydrogen atom, for example, aliphatic alcohols, acids, amides or alkyl phenols.

Non-ethoxylated nonionic detergents include alkyl polyglycosides, glycerol monoethers, and polyhydroxy amides (glucamide).

Specific nonionic detergent compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine.

Especially preferred are the primary and secondary alcohol ethoxylates, especially the $C_{9-11}$ and $C_{12-15}$ primary and secondary alcohols ethoxylated with an average of from 3 to 20 moles of ethylene oxide per mole of alcohol.

Nonionic detergent particles suitable for use in the present invention generally fall into one of two classes.

The first class comprises nonionic detergent carried on water-soluble carrier material. Suitable carrier materials include burkeite, sodium sesquicarbonate, sodium carbonate, sodium sulphate and mixtures thereof. A nonionic detergent particle comprising water-soluble carrier preferably comprises from 20 to 50% by weight, preferably from 25 to 40% by weight, of nonionic detergent.

The water-soluble carrier material is preferably present at a level exceeding 40% by weight, preferably 60% by weight or more.

The second class of nonionic detergent particle comprises water-insoluble carrier material. The insoluble carrier material may comprise silica or aluminosilicate, such as zeolite. However, it is preferred that, if aluminosilicate is present, the quantity is less than 10% by weight. Where an insoluble carrier material is used, the quantity of nonionic detergent may exceed 50% by weight of the particle, e.g. 52% or above.

Particles containing nonionic detergent absorbed on a solid carrier material can be made by spraying the nonionic detergent onto the carrier material in a granulator or some other type of mixing apparatus.

Other materials, serving to improve the physical properties of the particles, may also be included. Such materials are frequently referred to as "structuring agents". Examples are polyethylene/polypropylene glycol of average molecular weight in the region 4,000–12,000, sodium soap, polyvinyl alcohol of average molecular weight in the range 30,000–200,000, alkaline metal succinate etc may be present. The preferred quantity of structuring agent is in the region from 0.5 to 20% by weight. Structuring agent may be added with other ingredients or during a second granulation step. Preferred particles may contain at least 35% (of their own weight) of nonionic detergent, preferably from 40 to 55% by weight of nonionic detergent. A preferred carrier is silica having an oil absorption capacity of at least 1.0 ml/g. Oil absorption capacity is a parameter which is well known and can be measured by the technique described in DIN ISO 787/5. Preferably, the oil absorption capacity is at least 1.5 ml/g, more preferably at least 2.0 ml/g.

Preferably, there is at least 10%, more preferably at least 15% of such silica in the particles, and the quantity of silica in the particles is greater than the quantity if any, of aluminosilicate. The particles may contain less than 10% of their own weight of aluminosilicate.

Nonionic detergent particles can be manufactured by one or two step processes of mixing together components in a granulator (for example an Eirich RV02 granulator, or equipment such as the Fukae mixer from Fukae Powtech Co of Japan, the Diosna V-series supplied by Dierks & Sohne Germany, the Pharma Matrix ex TH Fielder Ltd England, the Lodige CB series and the Drais T160 series from Drais Werke, GmbH, Mannheim, Germany).

Nonionic detergent particles preferably have mean particle size in a range from 200 to 2,000 $\mu$m such that at least 80% of these particles have a particle size in the range from 180 to 2,000 $\mu$m. All or at least a high proportion, at least 50% or 80%, of the nonionic detergent present in the tablet or region thereof may be provided by the nonionic detergent particles defined above. Alternatively, the nonionic detergent particles defined above may only provide between 10 and 50% of the total nonionic detergent content of the tablet or region thereof and thus act as a supplement to another source of nonionic detergent, such as a base powder.

Nonionic detergent particles may provide from 2 or 3 to 30% of a tablet or a region of a tablet. Such particles may constitute from 8 to 20% of a tablet, more especially if these particles contain at least 40% of nonionic detergent. Their amount may be not over 8 to 10% of the weight of the tablet or region, especially if the nonionic detergent particles are not the only source of nonionic detergent in the tablet or region thereof.

Other classes of organic detergent, such as amphoteric detergent, may be included but are not preferred. It is desirable that all or substantially all e.g. at least 90% by weight of all non-soap organic detergent is contained in the said particles (A) which contain anionic detergent or in other particles which contain at least 20% of their own weight of non-anionic, non-soap organic detergent.

Disintegration Enhancing Particles

In accordance with this invention, a constituent of the tablet or region is particles containing material which serves to accelerate tablet disintegration in water and is either a material of high water-solubility or is a specified form of sodium tripolyphosphate, or a combination of the two. Such material may be present as at least 15 or 20% of the composition of a tablet or region thereof, possibly at least 25% up to 50 or 60%, possibly more.

Highly water soluble materials, which are one of the two possibilities are compounds, especially salts, with a solubility at 20° C. of at least 50 gms per 100 gms of water. A solubility of at least 50 grams per 100 grams of water at 20° C. is an exceptionally high solubility: many materials which are classified as water soluble are less soluble than this.

Some highly water-soluble materials which may be used are listed below, with their solubilities expressed as grams of solid to form a saturated solution in 100 grams of water at 20° C.:

| Material | Water Solubility (g/100 g) |
|---|---|
| Sodium citrate dihydrate | 72 |
| Potassium carbonate | 112 |
| Urea | >100 |
| Sodium acetate, anhydrous | 119 |
| Sodium acetate trihydrate | 76 |
| Magnesium sulphate $7H_2O$ | 71 |
| Potassium acetate | >200 |

By contrast the solubilities of some other common materials at 20° C. are:

| Material | Water Solubility (g/100 g) |
|---|---|
| Sodium chloride | 36 |
| Sodium sulphate decahydrate | 21.5 |
| Sodium carbonate anhydrous | 8.0 |
| Sodium percarbonate anhydrous | 12 |
| Sodium perborate anhydrous | 3.7 |
| Sodium tripolyphosphate anhydrous | 15 |

Preferably this highly water soluble material is incorporated as particles of the material in a substantially pure form (i.e. each such particle contains over 95% by weight of the material). However, the said particles may contain material of such solubility in a mixture with other material, provided that material of the specified solubility provides at least 50% by weight of these particles, better at least 80%.

Another possibility is that the said particles which promote disintegration are particles containing sodium tripolyphosphate with more than 50% of it (by weight of the particles) in the anhydrous phase I form. Such particles may contain at least 80% by weight tripolyphosphate and possibly at least 95%.

Sodium tripolyphosphate is very well known as a sequestering builder in detergent compositions. It exists in a hydrated form and two crystalline anhydrous forms. These are the normal crystalline anhydrous form, known as phase II which is the low temperature form, and phase I which is stable at high temperature. The conversion of phase II to phase I proceeds fairly rapidly on heating above the transition temperature, which is about 420° C., but the reverse reaction is slow. Consequently phase I sodium tripolyphosphate is metastable at ambient temperature.

A process for the manufacture of particles containing a high proportion of the phase I form of sodium tripolyphosphate by spray drying below 420° C. is given in U.S. Pat. No. 4,536,377.

Particles which contain this phase I form will often contain the phase I form of sodium tripolyphosphate as at least 55% by weight of the tripolyphosphate in the particles. Other forms of sodium tripolyphosphate will usually be present to a lesser extent. Other salts may be included in the particles, although that is not preferred.

Desirably, this sodium tripolyphosphate is partially hydrated. The extent of hydration should be at least 1% by weight of the sodium tripolyphosphate in the particles. It may lie in a range from 2.5 to 4%, or it may be higher, eg up to 8%.

Suitable material is commercially available. Suppliers include Rhone-Poulenc, France and Albright & Wilson, UK.

"Rhodiaphos HPA 3.5" from Rhone-Poulenc has been found particularly suitable. It is a characteristic of this grade of sodium tripolyphosphate that it hydrates very rapidly in a standard Olten test. We have found that it hydrates as quickly as anhydrous sodium tripolyphosphate, yet the prehydration appears to be beneficial in avoiding unwanted crystallisation of the hexahydrate when the material comes into contact with water at the time of use.

Detergency Builder

A tablet or tablet region will generally contain detergency builder. This may be sodium tripolyphosphate of the type just described. It may include sodium tripolyphosphate which has more of the phase II form or is hydrated. It may be some other type of detergency builder.

Water-soluble phosphorous-containing inorganic detergency builders include the alkali-metal orthophosphates, metaphosphates, pyrophosphates and polyphosphates, as well as sodium and potassium tripolyphosphates.

Alkali metal aluminosilicates are strongly favoured as environmentally acceptable water-insoluble builders for fabric washing. Alkali metal (preferably sodium) aluminosilicates may be either crystalline or amorphous or mixtures thereof, having the general formula:

$$0.8\text{–}1.5\ Na_2O.Al_2O_3.\ 0.8\text{–}6\ SiO_2.\ xH_2O$$

These materials contain some bound water (indicated as "xH2O") and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1429143 (Procter & Gamble). The preferred sodium aluminosilicates of this type are the well known commercially available zeolites A and X, and the novel maximum aluminium zeolite P described and claimed in EP 384070 (Unilever). This form of zeolite P is also referred to as zeolite MAP. One commercial form of it is denoted zeolite A24. Water-insoluble detergency builder could be a layered sodium silicate as described in U.S. Pat. No. 4,664,839.

NaSKS-6 is the trademark for a crystalline layered silicate marketed by Hoechst (commonly abbreviated as "SKS-6"). NaSKS-6 has the delta-$Na_2SiO_5$ morphology form of layered silicate. It can be prepared by methods such as described in DE-A-3,417,649 and DE-A-3,742,043. Other such layered silicates, which can be used have the general formula $NaMSi_xO_{2x+1}.yH_2O$ wherein M is sodium or hydrogen, x is a number from 1.9 to 4, preferably 2, and y is a number from 0 to 20, preferably 0.

Non-phosphorous water-soluble builders may be organic or inorganic. Inorganic builders that may be present include alkali metal (generally sodium) carbonate; while organic builders include polycarboxylate polymers, such as polyacrylates and acrylic/maleic copolymers, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates.

Tablet compositions preferably include polycarboxylate polymers, more especially polyacrylates and acrylic/maleic copolymers which can function as builders and also inhibit unwanted deposition onto fabric from the wash liquor.

Builder materials may be incorporated as particles which contain from 40 to 80% builder, the balance being other material, preferably 20 to 60% by weight of non-detergent material. Such particles may provide 10 to 60% of the composition.

Proportions

Generally, a tablet made in accordance with this invention will contain overall from 2 or 5 wt % up to 40 or 50 wt % non-soap detergent, and from 5 or 10 wt % up to 60 or 80wt % detergency builder. A discrete region of a heterogenous tablet may or may not contain these proportions of detergent and builder.

Base Powder

As indicated above, detergent tablets of the invention may contain anionic detergent particles which comprise at least 60% by weight anionic surfactant, along with at least one further source of anionic surfactant. This source may be a conventional detergent base powder produced, for example, by spray-drying or by granulation. Such a base powder may comprise between 5 and 30% by weight of anionic detergent, 3 to 20% of nonionic detergent and 20 to 50% of detergency builder. The base powder may be present as 30 to 60% by weight of the tablet or region thereof.

In an alternative embodiment, preferred for some markets, the tablet or region thereof may contain little or none of such a base powder (less than 20% by weight, preferably less than 10 or 5% by weight). In this case, the anionic detergent particles are likely to be the main source of anionic detergent in the tablet or region thereof.

Other ingredients

Detergent tablets according to the invention may contain a bleach system. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 25% by weight of the tablet.

Preferred inorganic persalts are sodium perborate monohydrate and tetrahydrate, and sodium percarbonate. Bleach activators have been widely disclosed in the art. Preferred examples include peracetic acid precursors, for example tetraacetylethylene diamine (TAED), and perbenzoic acid precursors. The quaternary ammonium and phosphonium bleach activators disclosed in U.S. Pat. No. 4,751,015 and U.S. Pat. No. 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272. A bleach system may also include a bleach stabiliser (heavy metal sequestrant) such as ethylenediamine tetramethylene phosphonate and diethylenetriamine pentamethylene phosphonate.

Bleach activator is usually present in an amount from 1 to 10% by weight of the tablet, possibly less in the case of a transition metal catalyst which may be used as 0.1% or more by weight of the tablet.

The detergent tablets of the invention may also contain one of the detergency enzymes well known in the art for their ability to degrade various soils and stains and so aid in their removal. Suitable enzymes include the various proteases, cellulases, lipases, amylases, and mixtures thereof, which are designed to remove a variety of soils and stains from fabrics. Detergency enzymes are commonly employed in the form of particles or marumes, optionally with a protective coating, in amount of from about 0.1% to about 3.0% by weight of the tablet.

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino) stilbene disulphonate; and Tinopal CBS is disodium 2,2'-bis-(phenylstyryl) disulphonate.

An antifoam material is advantageously included, especially if a detergent tablet is primarily intended for use in front-loading drum-type automatic washing machines. Antifoam materials in granular form are described in EP 266863A (Unilever). Such antifoam particles typically comprise a mixture of silicone oil, petroleum jelly, hydrophobic silica and alkyl phosphate as antifoam active material, sorbed onto a porous absorbed water-soluble carbonate-based inorganic carrier material.

It may also be desirable that a detergent tablet of the invention includes an amount of an alkali metal silicate, particularly sodium ortho-, meta- or disilicate. The presence of such alkali metal silicates may be advantageous in providing protection against the corrosion of metal parts in washing machines, besides providing some detergency building. Preferably the detergent-rich particles contain from 5 to 15% silicate by weight of the particles. This improves the strength and free flow of these particles prior to tableting.

Further ingredients which can optionally be employed in fabric washing detergent tablet of the invention include anti-redeposition agents such as sodium carboxymethylcellulose, straight-chain polyvinyl pyrrolidone and the cellulose ethers such as methyl cellulose and ethyl hydroxyethyl cellulose, fabric-softening agents; heavy metal sequestrants such as EDTA; perfumes; and colorants or coloured speckles.

Tableting

Tableting entails compaction of a particulate composition which includes the detergent containing particles, the disintegration promoting particles and any other ingredients. A variety of tableting machinery is known, and can be used. Generally it will function by stamping a quantity of the particulate composition which is confined in a mould.

Tableting may be carried out without application of heat, so as to take place at ambient temperature or at a temperature above ambient. In order to carry out the tableting at a temperature which is above ambient, the particulate composition is preferably supplied to the tableting machinery at an elevated temperature. This will of course supply heat to the tableting machinery, but the machinery may be heated in some other way also.

If any heat is supplied, it is envisaged that this will be supplied conventionally, such as by passing the particulate composition through an oven, rather than by any application of microwave energy.

Tablet Size and density

The size of a tablet will suitably range from 10 to 160 grams, preferably from 15 to 60 g, depending on the conditions of intended use, and whether it represents a dose for an average load in a fabric washing or dishwashing machine or a fractional part of such a dose. The tablets may be of any shape. However, for ease of packaging they are preferably blocks of substantially uniform cross-section, such as cylinders or cuboids. The overall density of a tablet preferably lies in a range from 1040 or 1050 gm/liter up to 1450 gm/liter or more. The tablet density may well lie in a range up to 1350 or 1400 gm/liter.

EXAMPLES 1 AND 2

Adjunct particles (LAI) containing 82% (of their own weight) of linear alkyl benzene sulphonate were prepared using a 1.2 $m^2$ VRV Flash Drier, in the manner described in WO 97/32002. It had three equal jacket sections. Dosing ports for both liquids and powders were situated just prior to the first hot section, with mid-jacket dosing ports available in the final two sections. Zeolite was added via this port in the final section. An electrically-powered oil heater provided the heating to the first two jacket sections, with oil temperatures between 120° C. and 190° C. being used. Ambient process water at 15° C. was used for cooling the jacket in the final section. Make-up air flow through the reactor was controlled between 10 and 50 $m^3$/hr by opening a bypass on the exhaust vapour extraction fan. The motor was run at full speed, giving a top speed of about 30 m/sec.

A mono pump was calibrated to dose ambient temperature LAS acid, and a peristaltic pump was calibrated to dose 47% sodium hydroxide. Screw feeders were calibrated to dose both sodium carbonate and zeolite A24. The sodium carbonate and the liquids were added just prior to the first hot section, but the zeolite was added into the third section which was cold.

The product was in the form of free-flowing particles containing

| | |
|---|---|
| Linear alkyl benzene sulphonate (LAS) | 82% |
| Sodium carbonate | 4% |
| Zeolite | 10% |
| Non-detergent organic impurities and moisture | 4% |

Nonionic detergent particles (ND1) containing 56% of nonionic detergent were prepared by granulating nonionic detergent with silica and soap in an Eirich RV02 granulator. (For larger scale a Loedige recycler would be appropriate).

The silica was Sorbosil TC15 supplied by Crosfield, Warrington, UK. The nonionic detergent was warmed and mixed with fatty acid, then sprayed on to the silica in the granulator, while simultaneously spraying on sufficient alkali to neutralise the fatty acid. The product was cooled in a fluidised bed which also removed fines. Oversize particles (>1400 $\mu$m) were sieved out. The resulting particles contained

| | |
|---|---|
| Nonionic detergent | 56% |
| Silica | 30% |
| Soap and moisture | 14% |

The above particles were mixed with other materials to make two detergent compositions set out in the table below. These included particles of sodium tripolyphosphate specified to contain 70% phase I form and contain 3.5% water of hydration (Rhodia-Phos HPA 3.5 available from Rhone-Poulenc).

| | Parts by Weight | |
|---|---|---|
| | Example 1 | Example 2 |
| Anionic detergent particles (LA1) | 13.5 | 13.5 |
| Nonionic detergent particles (ND1) | 8.9 | 8.9 |
| Rhodiaphos HPA 3.5 tripolyphosphate | 46.65 | 30.2 |
| Acrylate/maleate copolymer | 1.5 | 1.5 |
| Sodium silicate | 4.0 | 4.0 |
| Sodium carboxymethylcellulose particles (SCMC) | 0.3 | 0.3 |
| Fluorescer on inert carrier | 0.15 | 0.15 |
| Sodium percarbonate | 15.1 | 15.1 |
| TAED particles | 3.4 | 3.4 |
| Anti-foam particles | 3.2 | 3.2 |
| Sequestrant, soil-release polymer and coloured sodium carbonate particles | 2.7 | 2.7 |
| TOTAL | 99.4 | 82.95 |

A comparative detergent composition was made, starting with a spray-dried base powder (BP1) of the following composition:

| Ingredient | Parts by Weight |
|---|---|
| Sodium linear alkylbenzene sulphonate | 11.0 |
| $C_{13-15}$ fatty alcohol 7EO | 2.6 |
| $C_{13-15}$ fatty alcohol 3EO | 2.4 |
| Soap | 0.2 |
| Sodium tripolyphosphate* | 16.9 |
| Acrylate/maleate copolymer | 1.5 |
| Sodium silicate | 4.0 |
| Sodium carboxymethylcellulose particles | 0.3 |
| Fluorescer on inert carrier | 0.15 |
| moisture and impurities | 5.95 |
| TOTAL | 45 |

*Added to the slurry as anhydrous sodium tripolyphosphate containing at least 70% phase II form.

This powder was mixed with other ingredients as follows:

| Ingredient | Parts by Weight |
|---|---|
| Base powder (BP1) | 45 |
| Rhodiaphos HPA 3.5 tripolyphosphate | 30.2 |
| Sodium percarbonate | 15.1 |
| TAED particles | 3.4 |
| Anti-foam particles | 3.2 |
| Sequestrant, soil-release polymer and coloured sodium carbonate particles | 2.7 |
| TOTAL | 99.6 |

These compositions are also set out alongside each other in the following table:

| | Parts by weight | | |
|---|---|---|---|
| Ingredient | Example 1 | Example 2 | Comparative |
| Sodium linear alkylbenzene sulphonate | 11.0 | 11.0 | 11.0 |
| Nonionic detergent | 5.0 | 5.0 | 5.0 |
| aluminosilicate | 1.35 | 1.35 | 0 |
| silica | 2.65 | 2.65 | 0 |
| Rhodiaphos HPA 3.5 tripolyphosphate | 46.65 | 30.2 | 30.2 |
| other tripolyphosphate | 0 | 0 | 16.9 |
| Acrylate/maleate copolymer | 1.5 | 1.5 | 1.5 |
| Sodium silicate | 4.0 | 4.0 | 4.0 |
| Sodium percarbonate | 15.1 | 15.1 | 15.1 |
| TAED particles | 3.4 | 3.4 | 3.4 |
| Anti-foam particles | 3.2 | 3.2 | 3.2 |
| SCMC and fluorescer on carrier | 0.45 | 0.45 | 0.45 |
| Sequestrant, soil-release polymer and coloured sodium carbonate particles | 2.7 | 2.7 | 2.7 |
| Soap, sodium carbonate, moisture and impurities | 2.35 | 2.35 | 6.15 |
| Total | 99.35 | 82.9 | 99.6 |

40 gram portions of each composition were stamped into cylindrical tablets of 44 mm diameter. Various amounts of compaction force were used. The composition of Example 2 was also stamped into 32 gram tablets, so as to provide tablets of this composition containing the same amount of detergent as the 40 gram comparative tablets.

The speed of dissolution of the tablets was tested by means of a test procedure in which a tablet was placed on a plastic sieve with 2 mm mesh size, immersed in 9 liters of demineralised water at ambient temperature of 20° C. The sieve was fastened to a stirrer running at 200 rpm. The water conductivity was monitored until it reached a constant value. The time for dissolution of the tablets was taken as the time ($T_{90}$) for change in the water conductivity to reach 90% of its final magnitude.

Tablet strength was tested by a procedure in which a cylindrical tablet is compressed radially between the platens of a materials testing machine until the tablet fractures. At failure, the tablet cracks and the applied force needed to maintain the displacement of the platens drops. Measurement is discontinued when the applied force needed to maintain the displacement has dropped by 25% from its maximum value.

The maximum force is the force at failure ($F_f$). From this measurement of force a test parameter called diametral fracture stress, was calculated using the equation $$\sigma = 2\frac{Ff}{\pi Dt}$$

where σ is the diametral fracture stress in Pascals, $F_f$ is the applied force in Newtons to cause fracture, D is the tablet diameter in meters and t is the tablet thickness in meters.

The force to cause fracture and the diametral fracture stress calculated from it are a direct assessment of strength and indicate the tablets' resistance to breakage when handled by a consumer at the time of use. The amount of energy (or mechanical work) put in prior to fracture is a measure of tablet deformability and is relevant to the tablets' resistance to breakage during transport. This energy or work prior to failure is assessed as the "break energy" which is the area under a graph of force against displacement, up to the point of break. It is given by the equation:

$$E_b = \int_0^{x_f} F(x)\,dx$$

where $E_b$ is the break energy in joules, x is the displacement in meters,

F is the applied force in Newtons at displacement x, and $x_f$ is the displacement at failure.

The values of dissolution time, fracture stress and break energy are set out in the following two tables which are arranged to show comparison of tablets with similar diametral fracture stress (DFS):

| | Example 1 as 40 gram tablets | | | Comparative as 40 gram tablets | | |
|---|---|---|---|---|---|---|
| Compaction force (kN) | DFS (kpa) | $T_{90}$ (sec) | $E_b$ (mJ) | DFS (kPa) | $T_{90}$ (sec) | $E_b$ (mJ) |
| 30 | 55.8 | 180 | 20.5 | | | |
| 9.7 | | | | 54.2 | 400 | 15 |
| 15 | 27.4 | 140 | 13.9 | | | |
| 9.7 | 18.6 | 105 | 6.7 | | | |
| 5.0 | | | | 20.9 | 220 | 6.4 |
| 5.0 | 7.4 | 115 | 2.8 | | | |
| 2.5 | | | | 6.5 | 190 | 2.25 |

| Compaction | Example 2 as 40 gram tablets | | | Example 2 as 32 gram tablets | | | Comparative as 40 gram tablets | | |
|---|---|---|---|---|---|---|---|---|---|
| force (kN) | DFS (kpa) | $T_{90}$ (sec) | $E_b$ (mJ) | DFS (kPa) | $T_{90}$ (sec) | $E_b$ (mJ) | DFS (kPa) | $T_{90}$ (sec) | $E_b$ (mJ) |
| 9.7 | | | | | | | 54.2 | 400 | 15 |
| 15 | 39.1 | 250 | 20.3 | 36.1 | 275 | 22.9 | | | |
| 7.5 | | | | | | | 36.8 | 310 | 10.5 |
| 9.7 | 29.9 | 200 | 15.2 | 23.4 | 240 | 14.1 | | | |
| 5.0 | | | | | | | 20.9 | 220 | 6.4 |
| 5.0 | 10.8 | 145 | 6.1 | 9.8 | 140 | 5.7 | | | |
| 2.5 | | | | | | | 6.5 | 190 | 2.25 |

It is apparent that the invention makes it possible to increase break energy, reduce dissolution time and/or reduce the weight of the tablet needed to deliver the same quantity of detergent.

EXAMPLE 3

Adjunct particles as described in the preceding examples were used to make tablets of the following formulation:

| | Parts by Weight |
|---|---|
| Anionic detergent particles (LA1) | 16.0 |
| Nonionic detergent particles (ND1) | 10.0 |
| Rhodiaphos HPA 3.5 tripolyphosphate | 48.0 |
| Acrylate/maleate copolymer | 2.0 |
| Sodium silicate | 4.0 |
| Sodium carboxymethylcellulose particles | 0.5 |
| Polyvinylpyrrolidone | 1.0 |
| Sodium carbonate | 7.0 |
| Sodium sulphate | 5.0 |
| Anti-foam particles | 3.5 |
| Sequestrant, soil-release polymer and coloured sodium carbonate particles | 3.0 |
| TOTAL | 100 |

EXAMPLE 4

Adjunct particles (LA1 and ND1) as described in Examples 1 and 2 together with further ingredients were used to make 40 gram tablets with two layers of unequal weight (10 grams and 30 grams). The overall formulation was similar to Example 1 but contained slightly more alkylbenzene sulphonate and slightly less tripolyphosphate. A base powder (BP1A) with the same composition as used in Examples 1 and 2 but taken from a different batch, was used to make comparative tablets with two layers of unequal weight. The overall formulation was the same as for the previous comparative tablets.

When making these two layer tablets, the composition for one layer was placed in a mould and lightly compacted, the composition for the other layer was then added to the mould, and compaction force was applied to the mould contents. The formulations are set out in the table below:

| | Parts by Weight | | | | | |
|---|---|---|---|---|---|---|
| | Comparative | | | Example 4 | | |
| | thin layer | thick layer | total | thin layer | thick layer | total |
| Base powder (BP1A) | 4.57 | 13.6 | 18.17 | — | — | — |
| Anionic detergent particles (LA1) | — | — | — | 1.59 | 4.73 | 6.32 |
| Nonionic detergent particles (ND1) | — | — | — | 0.90 | 2.67 | 3.57 |
| Rhodiaphos HPA3.5 tripolyphosphate | 3.05 | 9.07 | 12.12 | 4.51 | 13.4 | 17.9 |
| | | | | | 2 | 3 |
| Acrylate/maleate copolymer | — | — | — | 0.15 | 0.45 | 0.6 |
| Sodium silicate | — | — | — | 0.40 | 1.20 | 1.6 |
| SCMC particles, fluorescer & soil release polymer | — | — | — | 0.07 | 0.20 | 0.27 |
| Sodium percarbonate | 0 | 6.05 | 6.05 | 0 | 6.05 | 6.05 |
| TAED particles | 1.36 | 0 | 1.36 | 1.36 | 0 | 1.36 |
| Anti-foam particles | 0 | 1.28 | 1.28 | 0 | 1.28 | 1.28 |
| Sequestrant, and coloured sodium carbonate particles | 1.02 | 0 | 1.02 | 1.02 | 0 | 1.02 |
| TOTAL | 10 | 30 | 40 | 10 | 30 | 40 |

The tablets and comparative tablets were tested in the same ways as was done for Examples 1 and 2 above, with the following results:

| | Example 4 | | | Comparative two layer tablets | | |
|---|---|---|---|---|---|---|
| Compaction force (kN) | DFS (kPa) | $T_{90}$ (sec) | $E_b$ (mJ) | DFS (kPa) | $T_{90}$ (sec) | $E_b$ (mJ) |
| 30 | 55.8 | 120 | 41.7 | | | |
| 20 | 43.1 | 115 | 28.0 | | | |
| 9.7 | 21.4 | 105 | 10.6 | 52.1 | 275 | 15.7 |
| 5.0 | 8.2 | 105 | 2.7 | 21.8 | 210 | 7.1 |
| 2.5 | | | | 7.0 | 135 | 2.6 |

EXAMPLES 5 AND 6

Anionic detergent particles (LA2) were produced in the same equipment as for the particles LA1 and consisted of:

| Ingredients | % by weight |
|---|---|
| Linear alkylbenzene sulphonate (LAS) | 70% |
| Zeolite | 25% |
| Sodium carbonate | 2% |
| Non-detergent impurities and moisture | 3% |

Nonionic detergent particles (ND2) were produced by granulating zeolite A24 which is maximum aluminium zeolite P from Crosfields with trisodium citrate in a Lödige recycler. Nonionic detergent was mixed with fatty acid and sprayed in while also spraying in sufficient 50% aqueous sodium hydroxide to neutralise the fatty acid. The resulting product contained

| ND2 : Ingredient | % by weight |
|---|---|
| Zeolite A24 | 53.8 |
| Sodium Citrate | 7.9 |
| Nonionic detergent | 24.2 |
| Soap | 4.1 |
| Water | 10.0 |

Zeolite builder particles B1 were produced by continuously dosing zeolite A24, granular trisodium citrate and a 40% solution of acrylate/maleate copolymer (Sokolan CP5 solution) into a Lödige CB30 recycler. The CB30 was operated at 1500 rpm. The exiting powder was led through a Lödige KM300 ploughshare (120 rpm), in which densification took place. The resulting powder was dried in a fluid bed with a air temperature of 110° C. The composition of the resulting builder particle was:

| ZB1 : Ingredient | % by weight |
|---|---|
| Zeolite A24 | 53.6 |
| Trisodium Citrate | 17.2 |
| Sokolan CP5 | 19.0 |
| Water etc. | 10.2 |

A granulated base powder (BP2) of the following composition, made by mixing under high shear followed by densification under reduced shear, had the following composition:

| BP2 : Ingredient | parts by weight | % by weight |
|---|---|---|
| Sodium linear alkylbenzene sulphonate | 9.35 | 20.8 |
| $C_{13-15}$ fatty alcohol 7EO. | 2.68 | 6.0 |
| $C_{13-15}$ fatty alcohol 3EO. | 1.43 | 3.2 |
| Soap | 0.72 | 1.6 |
| Zeolite A24 | 20.9 | 46.4 |
| Sodium acetate trihydrate | 2.67 | 5.9 |
| sodium carbonate | 3.1 | 6.9 |
| Sodium carboxymethylcellulose | 0.41 | 0.9 |
| moisture and impurities | 3.74 | 8.3 |
| TOTAL | 45 | 100 |

Adjunct particles ND1 as described in Examples 1 and 2 and the particles LA2, ND2 and ZB1 described above were used to make tablets of the two formulations shown in the table below.

Comparative tablets were made using the above granulated base powder (BP2) and are also shown in the table below.

| | Parts by Weight | | |
|---|---|---|---|
| | Comparative | Example 5 | Example 6 |
| Base powder BP2 | 18.3 | — | — |
| Anionic detergent particles LA2 | — | 5.43 | 5.43 |
| Nonionic on zeolite particles ND2 | — | 6.91 | — |
| Nonionic on silica particles ND1 | — | — | 2.99 |
| Zeolite builder particles ZB1 | — | 6.39 | 13.33 |
| Sodium carbonate | — | 1.26 | 1.26 |

-continued

| | Parts by Weight | | |
|---|---|---|---|
| | Comparative | Example 5 | Example 6 |
| Acrylate/maleate copolymer | 0.53 | 0.53 | 0.53 |
| Sodium disilicate | 1.44 | 1.44 | 1.44 |
| Sodium carboxymethyl-cellulose particles | — | 0.17 | 0.17 |
| Sodium percarbonate | 5.92 | 5.92 | 5.92 |
| TAED particles | 2.09 | 2.09 | 2.09 |
| Sodium acetate trihydrate mixed with 1% of its own weight of zeolite | 9.29 | 10.38 | 10.38 |
| Anti-foam particles | 0.74 | 0.74 | 0.74 |
| Sequestrant, fluorescer, soil-release polymer and coloured sodium carbonate particles | 1.68 | 1.68 | 1.68 |
| TOTAL | 39.99 | 42.94 | 45.96 |

Tablets were made containing 40 grams of the comparative composition, or 43 grams of the composition of example 5 or 46 grams of the composition of Example 6. These tablets all contained 3.8 parts of alkylbenzene sulphonate, 1.67 parts of nonionic detergent, 8.5 parts of zeolite and 10.4 parts of sodium acetate trihydrate. The tablets were compacted with an applied force of 9.7 kN and tested as in Examples 1 and 2. The following results were obtained:

| | Comparative | Example 5 | Example 6 |
|---|---|---|---|
| DFS (kPa) | 26.1 | 18.9 | 21.5 |
| $T_{90}$ (sec) | 127 | 123 | 120 |
| $E_b$ (mJ) | 7.0 | 9.2 | 17.3 |

It may be noted that in Example 3 of our EP 838519, a DFS of 20.8 kPa was accompanied by a $T_{90}$ of 450 seconds.

EXAMPLE 7

A further detergent composition according to the invention was prepared using the granulated base powder (BP2) of Examples 5 and 6 in combination with the adjunct particles (LA1) of Example 1, along with other ingredients, in the following proportions:

| | Parts by Weight |
|---|---|
| Base Powder BP2 | 51.0 |
| Anionic particles LA1 | 5.2 |
| Sodium percarbonate | 10.6 |
| TAED particles | 3.4 |
| Sodium acetate trihydrate mixed with 1% of its own weight of zeolite | 20.1 |
| Acrylate/maleate copolymer | 1.2 |
| Sodium disilicate | 2.6 |
| Anti-foam particles | 1.3 |
| Sequestrant, fluorescer, soil-release polymer and coloured sodium carbonate particles | 4.1 |
| Total | 99.5 |

Tablets were made containing 40 gram of the above composition, using a compaction force of 9.7 kN.

What is claimed is:

1. A detergent tablet of compressed particulate composition, wherein the tablet or a region thereof comprises organic detergent and detergency builder, wherein the tablet or region thereof is compacted from a composition which contains:

(A) particles containing at least 60% by weight of non-soap anionic detergent and less than 25% by weight of aluminosilicate builder and having a solid material selected from the group consisting of zeolite and silica particles at their surface; and (B) particles containing at least 80% of their own weight of one or more water-soluble materials selected from the group consisting of compounds with a water-solubility exceeding 50 grams per 100 grams water at 20° C.

2. A tablet according to claim 1 containing from 3 to 30% by weight of the tablet or the region thereof of said particles (A).

3. A tablet according to claim 1 containing from 15 to 60% by weight of the tablet or the region thereof of said particles (B).

4. A tablet according to claim 3 containing from 25 to 50% by weight of the tablet or the region thereof of said particles (B).

5. A tablet according to claim 1 wherein the particles (A) contain from 66 to 96% by weight of non-soap anionic detergent.

6. A tablet according to claim 1 containing at least 20% by weight of the tablet or the region thereof of said particles (B) which themselves contain at least 80% of their own weight of one or more salts with a water-solubility exceeding 50 grams per 100 grams water at 20° C.

7. A tablet according to claim 6 wherein said compound is one of more of partially or completely hydrated sodium citrate, partially or completely hydrated sodium acetate, and potassium acetate.

8. A tablet according to claim 1 wherein the tablet or region thereof also contains particles which themselves contain at least 20% by weight of nonionic detergent.

9. A tablet according to claim 8 wherein the tablet or region thereof contains from 3 to 30% by weight of the tablet or region of particles which contain the at least 20% by weight of nonionic detergent.

10. A tablet according to claim 9 wherein at least 90% by weight of the organic detergent in the tablet or region thereof is contained in said particles (A) or in particles which contain at least 20% of their own weight of nonionic detergent.

11. A tablet according to claim 8 wherein at least 90% by weight of the organic detergent in the tablet or region thereof is contained in said particles (A) or in particles which contain at least 20% of their own weight of non-anionic, non-soap detergent.

12. A tablet according to claim 1 wherein, overall, said tablet contains from 5 to 40% of organic detergent and from 15 to 80% of detergency builder.

13. A tablet according to claim 12 containing overall from 30 to 60% by weight sodium tripolyphosphate, reckoned as anhydrous.

14. A tablet according to claim 1 wherein the composition of the tablet or region thereof further comprises from 10 to 60% of particles which contain from 40 to 80% of their own weight of detergency builder and 20 to 60% of their own weight of, non-detergent material.

15. A process for making a tablet as defined in claim 1 which process comprises mixing ingredients comprising said particles (A) with said particles (B), and then compacting the resulting composition into tablets.

16. A detergent tablet of compressed particulate composition, wherein the tablet or a region thereof comprises organic detergent and detergency builder, wherein the tablet or region thereof is compacted from a composition which contains:

(A) particles containing at least 60% by weight of non-soap anionic detergent, and (B) particles containing at least 80% of their own weight of sodium tripolyphosphate containing at least 50% of its own weight of the phase I anhydrous form.

17. A tablet according to claim 16 containing from 3 to 30% by weight (of the tablet or the region thereof of said particles (A).

18. A tablet according to claim 16 containing from 15 to 60% by weight of the tablet or the region thereof of said particles (B).

19. A tablet according to claim 18 containing from 25 to 50% by weight of the tablet or the region thereof of said particles (B).

20. A tablet according to claim 16 wherein the particles (A) contain from 66 to 96% by weight of non-soap anionic detergent.

21. A tablet according to claim 16 wherein the tablet or the region thereof also contains particles which themselves contain at least 20% of nonionic detergent.

22. A tablet according to claim 16 wherein, overall, said tablet contains from 5 to 40% of organic detergent and from 15 to 80% of detergency builder.

23. A tablet according to claim 16 wherein the composition of the tablet or the region thereof further comprises from 10 to 60% of particles which contain from 40 to 80% of their own weight of detergency builder and 20 to 60% of their own weight of non-detergent material.

24. A tablet according to claim 16 wherein the particles (A) have solid material selected from the group consisting of zeolite and silica particles at their surface.

25. A tablet according to claim 16 containing from 20 to 60% by weight of the tablet or the region thereof of said particles B which contain said tripolyphosphate which is partially hydrated so as to contain water of hydration in an amount which is at least 1 % by weight of the sodium tripolyphosphate.

26. A tablet according to claim 25 containing 25 to 55% by weight of the tablet or the region thereof of said particles (B) which contain at least 95% of their own weight of said tripolyphosphate, which is partially hydrated so as to contain water of hydration in an amount which is at least 1% by weight of the sodium tripolyphosphate.

* * * * *